US008739561B2

(12) United States Patent
Kurihara

(10) Patent No.: US 8,739,561 B2
(45) Date of Patent: Jun. 3, 2014

(54) TURBO COMPRESSOR, TURBO REFRIGERATOR, AND METHOD OF MANUFACTURING TURBO COMPRESSOR

(75) Inventor: Kazuaki Kurihara, Yokohama (JP)

(73) Assignee: IHI Corporation (JP)

( * ) Notice: Subject to any disclaimer, the term of this patent is extended or adjusted under 35 U.S.C. 154(b) by 353 days.

(21) Appl. No.: 13/069,573

(22) Filed: Mar. 23, 2011

(65) Prior Publication Data

US 2011/0232324 A1 Sep. 29, 2011

(30) Foreign Application Priority Data

Mar. 23, 2010 (JP) ..... P2010-066553

(51) Int. Cl.
*F25B 1/00* (2006.01)

(52) U.S. Cl.
USPC ..... 62/115; 62/259.2; 62/498

(58) Field of Classification Search
CPC ..... F25B 41/062; F25B 49/022; F25B 1/00; F24F 13/20; F25D 23/006; G06F 1/20; H01L 23/427; H01L 23/473; F28B 1/10; F28B 13/00; F28B 9/008
USPC ..... 62/115, 259.2, 498, 298; 415/122.1; 417/360, 407; 29/888.02
See application file for complete search history.

(56) References Cited

U.S. PATENT DOCUMENTS

| | | | | |
|---|---|---|---|---|
| 4,969,805 | A * | 11/1990 | Romeo | 417/360 |
| 7,690,887 | B2 * | 4/2010 | Takahashi et al. | 415/99 |
| 2007/0147984 | A1 * | 6/2007 | Takahashi et al. | 415/100 |

FOREIGN PATENT DOCUMENTS

| | | | |
|---|---|---|---|
| CN | 1272907 | A | 11/2000 |
| CN | 1329699 | A | 1/2002 |
| CN | 1461896 | A | 12/2003 |
| CN | 101344036 | A | 1/2009 |
| CN | 101504009 | A | 8/2009 |
| EP | 0 395 826 | A1 | 11/1990 |
| JP | 51-133003 | | 10/1976 |
| JP | 61-202644 | | 12/1986 |
| JP | 4-008919 | | 1/1992 |
| JP | 2002-349484 | | 12/2002 |
| JP | 2009-185708 | | 8/2009 |
| JP | 2009-185713 | | 8/2009 |
| KR | 10-2004-0036656 | | 4/2004 |
| WO | WO 02/23047 | | 3/2002 |

OTHER PUBLICATIONS

Office Action dated Jul. 18, 2013 issued in corresponding Chinese Patent Application No. 201110070628.5 with English translation.
Japanese Office Action, dated Sep. 17, 2013, issued in corresponding Japanese Patent Application No. 2010-066553. English translation. Total 4 pages.
Chinese Office Action, dated Jan. 21, 2013, issued in corresponding Chinese Application No. 201110070628.5 English translation included. Total 13 pages.

* cited by examiner

*Primary Examiner* — Mohammad M Ali
(74) *Attorney, Agent, or Firm* — Ostrolenk Faber LLP

(57) ABSTRACT

A turbo compressor includes an impeller fixed to one end portion of a rotation shaft by a predetermined fastening member, and a regulating portion which is used to regulate rotation of the rotation shaft during fastening of the fastening member and is provided in the other end portion of the rotation shaft. The regulating portion is formed as a recessed portion recessed from an end surface of the other end portion of the rotation shaft.

8 Claims, 6 Drawing Sheets

TURBO COMPRESSOR, TURBO REFRIGERATOR, AND METHOD OF MANUFACTURING TURBO COMPRESSOR

BACKGROUND OF THE INVENTION

1. Field of the Invention

The present invention relates to a turbo compressor, a turbo refrigerator, and a method of manufacturing a turbo compressor.

Priority is claimed on Japanese Patent Application No. 2010-066553, filed on Mar. 23, 2010, the content of which is incorporated herein by reference.

2. Description of Related Art

As a refrigerator that cools or freezes cooling objects such as water, a turbo refrigerator having a turbo compressor that compresses and discharges a refrigerant gas is known. In the turbo compressor included in the turbo refrigerator, an impeller that sends the refrigerant gas in a predetermined direction in order to compress the refrigerant gas is provided so as to be rotatable (For example, refer to Japanese Patent Application, First Publication No. 2009-185713). The impeller is fixed to one end portion of a rotation shaft by a predetermined fastening member (such as a nut).

When the fastening member is fastened to the one end portion of the rotation shaft, in order to prevent co-rotation of the rotation shaft due to the fastening operation, the rotation of the rotation shaft needs to be regulated. Therefore, the other end portion of the rotation shaft is provided with a regulating portion having the shape of the head portion of a hexagon bolt, which is used for regulating the rotation. During fastening of the fastening member, in a state where the regulating portion is held by a rotation regulating tool (such as a wrench) and thus regulates the rotation of the rotation shaft, the fastening member is fastened to the one end portion of the rotation shaft. However, since the regulating portion is provided to protrude from an end surface of the other end portion of the rotation shaft, there is a problem in that the overall length of the rotation shaft is increased. As the rotation shaft is lengthened, for example, there is a problem in that the size of the turbo compressor is increased, resulting in an increase in the weight of the turbo compressor.

In order to solve the above-mentioned problems, an object of the invention is to provide a turbo compressor, a turbo refrigerator, and a method of manufacturing a turbo compressor, capable of reducing the overall length of a rotation shaft while a regulating portion used for regulating the rotation of the rotation shaft is provided in the rotation shaft.

SUMMARY OF THE INVENTION

In order to accomplish the object, the invention employs the following means.

A turbo compressor according to the invention includes an impeller fixed to one end portion of a rotation shaft by a predetermined fastening member, and a regulating portion which is used to regulate rotation of the rotation shaft during fastening of the fastening member and is provided in the other end portion of the rotation shaft, and employs a configuration in which the regulating portion is formed as a recessed portion recessed from an end surface of the other end portion of the rotation shaft.

According to the invention, the regulating portion used to regulate the rotation of the rotation shaft during the fastening of the fastening member is provided without protruding from the end surface of the other end portion of the rotation shaft.

In addition, in the turbo compressor according to the invention, it is preferable that a plurality of the recessed portions be provided.

In addition, in the turbo compressor according to the invention, it is preferable that the recessed portion be a female threaded portion.

In addition, in the turbo compressor according to the invention, it is preferable that a cross-sectional shape of the recessed portion on a surface perpendicular to the axial line of the rotation shaft be polygonal.

In addition, it is preferable that a turbo refrigerator according to the invention include a condenser which cools a compressed refrigerant so as to liquefy, an evaporator which takes away heat of vaporization from a cooling object that vaporizes the liquefied refrigerant thereby cooling the cooling object, and a compressor which compresses the refrigerant vaporized by the evaporator and supplies the compressed refrigerant to the condenser, and the turbo compressor be included as the compressor.

In addition, it is preferable that a method of manufacturing a turbo compressor which includes an impeller fixed to one end portion of a rotation shaft by a predetermined fastening member, and a regulating portion which is used to regulate rotation of the rotation shaft during fastening of the fastening member and is provided in the other end portion of the rotation shaft, include: a first manufacturing step of holding a casing of the turbo compressor using a predetermined holding stand; a second manufacturing step of installing the rotation shaft in the casing so as to be rotatable; a third manufacturing step of connecting a rotation regulating member that regulates the rotation of the rotation shaft by cooperating with the regulating portion, to the regulating portion formed as a recessed portion recessed from an end surface of the other end portion of the rotation shaft; and a fourth manufacturing step of fixing the impeller to the one end portion of the rotation shaft using the fastening member in a state where the rotation regulating member is locked by a part of the holding stand.

In this case, it is possible to regulate the rotation of the rotation shaft during the fastening of the fastening member using the regulating portion provided without protruding from the end surface of the other end portion of the rotation shaft.

In addition, in the method of manufacturing the turbo compressor according to the invention, it is preferable that the recessed portion be a female threaded portion, and in the third manufacturing step, the rotation regulating member is fixed to the regulating portion by a threaded member screwed to the female threaded portion.

According to the invention, the following advantages can be obtained.

According to the invention, the regulating portion used to regulate the rotation of the rotation shaft is provided without protruding from the end surface of the other end portion of the rotation shaft. Accordingly, there is an advantage that the overall length of the rotation shaft in the turbo compressor and the turbo refrigerator can be reduced. In addition, there is an advantage that the turbo compressor having the rotation shaft the overall length of which is reduced can be manufactured while including the regulating portion.

DETAILED DESCRIPTION OF THE INVENTION

Figure 1:
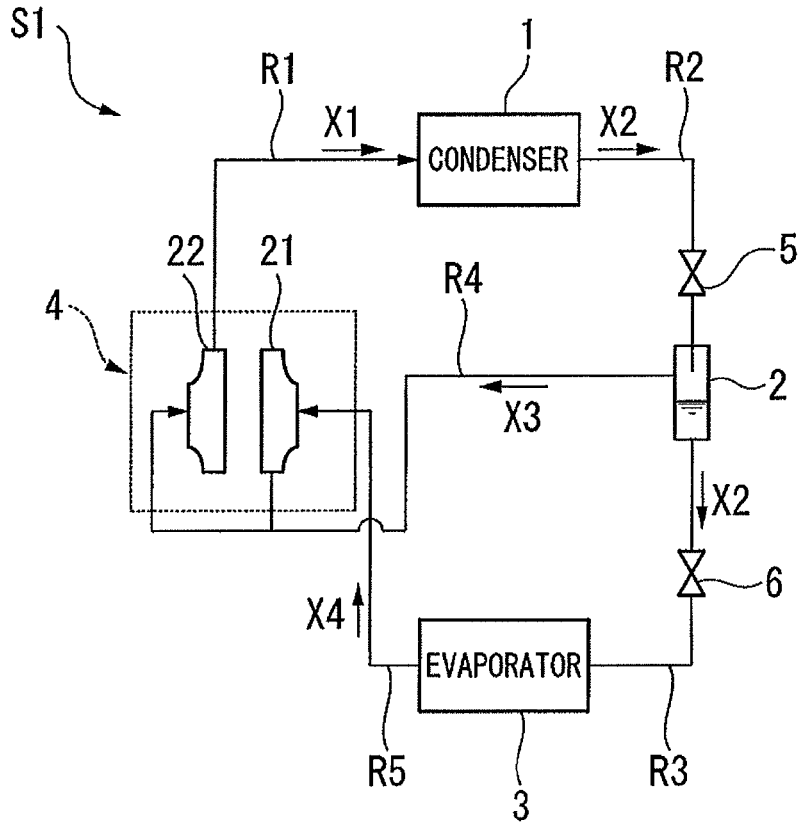
FIG. 1 is a block diagram showing a simplified configuration of a turbo refrigerator according to an embodiment of the invention.

Hereinafter, exemplary embodiments of the invention will be described with reference to FIGS. 1 to 6B. In the drawings used for the following description, in order to allow each member to have a recognizable size, the scale of each member is appropriately changed.

FIG. 1 is a block diagram showing a simplified configuration of a turbo refrigerator S1 according to this embodiment. The turbo refrigerator S1 according to this embodiment is installed, for example, at a building, a factory, or the like in order to generate air-conditioning cooling water and includes, as shown in FIG. 1, a condenser 1, an economizer 2, an evaporator 3, and a turbo compressor 4.

A compressed refrigerant gas X1 which is a refrigerant in a compressed gas state is supplied to the condenser 1, and the condenser 1 cools the compressed refrigerant gas X1 to liquefy and become a refrigerant liquid X2. The condenser 1 is, as shown in FIG. 1, connected to the turbo compressor 4 via a flow path R1 through which the compressed refrigerant gas X1 flows, and is connected to the economizer 2 via a flow path R2 through which the refrigerant liquid X2 flows. The flow path R2 is provided with an expansion valve 5 for reducing the pressure of the refrigerant liquid X2.

The economizer 2 temporarily stores the refrigerant liquid X2 the pressure of which is reduced by the expansion valve 5. The economizer 2 is connected to the evaporator 3 via a flow path R3 through which the refrigerant liquid X2 flows, and is connected to the turbo compressor 4 via a flow path R4 through which a gas-phase component X3 of the refrigerant generated in the economizer 2 flows. The flow path R3 is provided with an expansion valve 6 for further reducing the pressure of the refrigerant liquid X2. In addition, the flow path R4 is connected to the turbo compressor 4 so as to supply the gas-phase component X3 to a second compression stage 22 included in the turbo compressor 4, which will be described later.

The evaporator 3 vaporizes the refrigerant liquid X2 to take away heat of vaporization from a cooling object such as water, thereby cooling the cooling object. The evaporator 3 is connected to the turbo compressor 4 via a flow path R5 through which a refrigerant gas X4 generated by vaporizing of the refrigerant liquid X2 flows. The flow path R5 is connected to a first compression stage 21 included in the turbo compressor 4, which will be described later.

The turbo compressor 4 compresses the refrigerant gas X4 to be used as the compressed refrigerant gas X1. The turbo compressor 4 is connected to the condenser 1 via the flow path R1 through which the compressed refrigerant gas X1 flows as described above, and is connected to the evaporator 3 via the flow path R5 through which the refrigerant gas X4 flows.

In the turbo refrigerator S1, the compressed refrigerant gas X1 supplied to the condenser 1 via the flow path R1 is cooled and liquefied by the condenser 1 and becomes the refrigerant liquid X2. The pressure of the refrigerant liquid X2 is reduced by the expansion valve 5 when the refrigerant liquid X2 is supplied to the economizer 2 via the flow path R2, and the refrigerant liquid X2 is temporarily stored in the economizer 2 in the pressure-reduced state. Thereafter, the pressure of the refrigerant liquid X2 is further reduced by the expansion value 6 when the refrigerant liquid X2 is supplied to the evaporator 3 via the flow path R3. Therefore, the refrigerant liquid X2 is supplied to the evaporator 3 while the pressure thereof is reduced in two stages. The refrigerant liquid X2 supplied to the evaporator 3 is vaporized by the evaporator 3 and becomes the refrigerant gas X4, and is supplied to the turbo compressor 4 via the flow path R5. The refrigerant gas X4 supplied to the turbo compressor 4 is compressed by the turbo compressor 4 and thus becomes the compressed refrigerant gas X1, and is again supplied to the condenser 1 via the flow path R1.

The gas-phase component X3 of the refrigerant generated when the refrigerant liquid X2 is stored in the economizer 2 is supplied to the turbo compressor 4 via the flow path R4, is compressed along with the refrigerant gas X4, and is supplied to the condenser 1 via the flow path R1 as the compressed refrigerant gas X1.

In the turbo refrigerator S1, when the refrigerant liquid X1 is vaporized by the evaporator 3, heat of vaporization is taken away from the cooling object, thereby cooling or freezing the cooling object.

Figure 2:
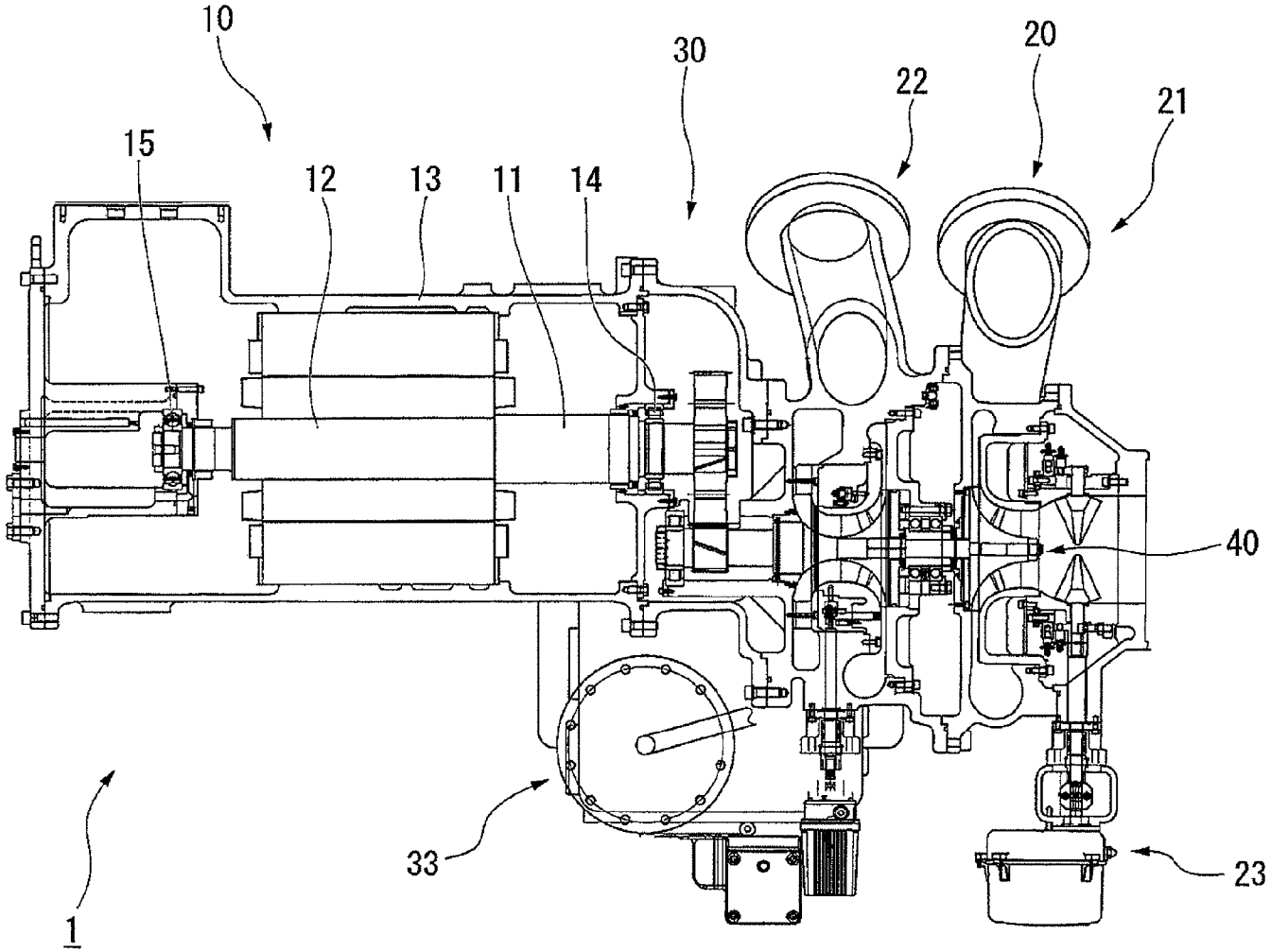
FIG. 2 is a horizontal cross-sectional view of a turbo compressor according to the embodiment of the invention.

Subsequently, the turbo compressor 4 having features of this embodiment will be described in more detail. FIG. 2 is a horizontal cross-sectional view of the turbo compressor 4 according to this embodiment.

As shown in FIG. 2, the turbo compressor 4 according to this embodiment includes a motor unit 10, a compressor unit 20, and a gear unit 30.

The motor unit 10 has an output shaft 11 and includes a motor 12 which is a drive source for driving the compressor unit 20 and a motor casing 13 that encloses the motor 12 and in which the motor 12 is installed. The drive source for driving the compressor unit 20 is not limited to the motor 12, and for example, an internal combustion engine may also be employed. The output shaft 11 of the motor 12 is supported by a first bearing 14 and a second bearing 15 which are fixed to the motor casing 13 so as to be rotatable.

Figure 3:
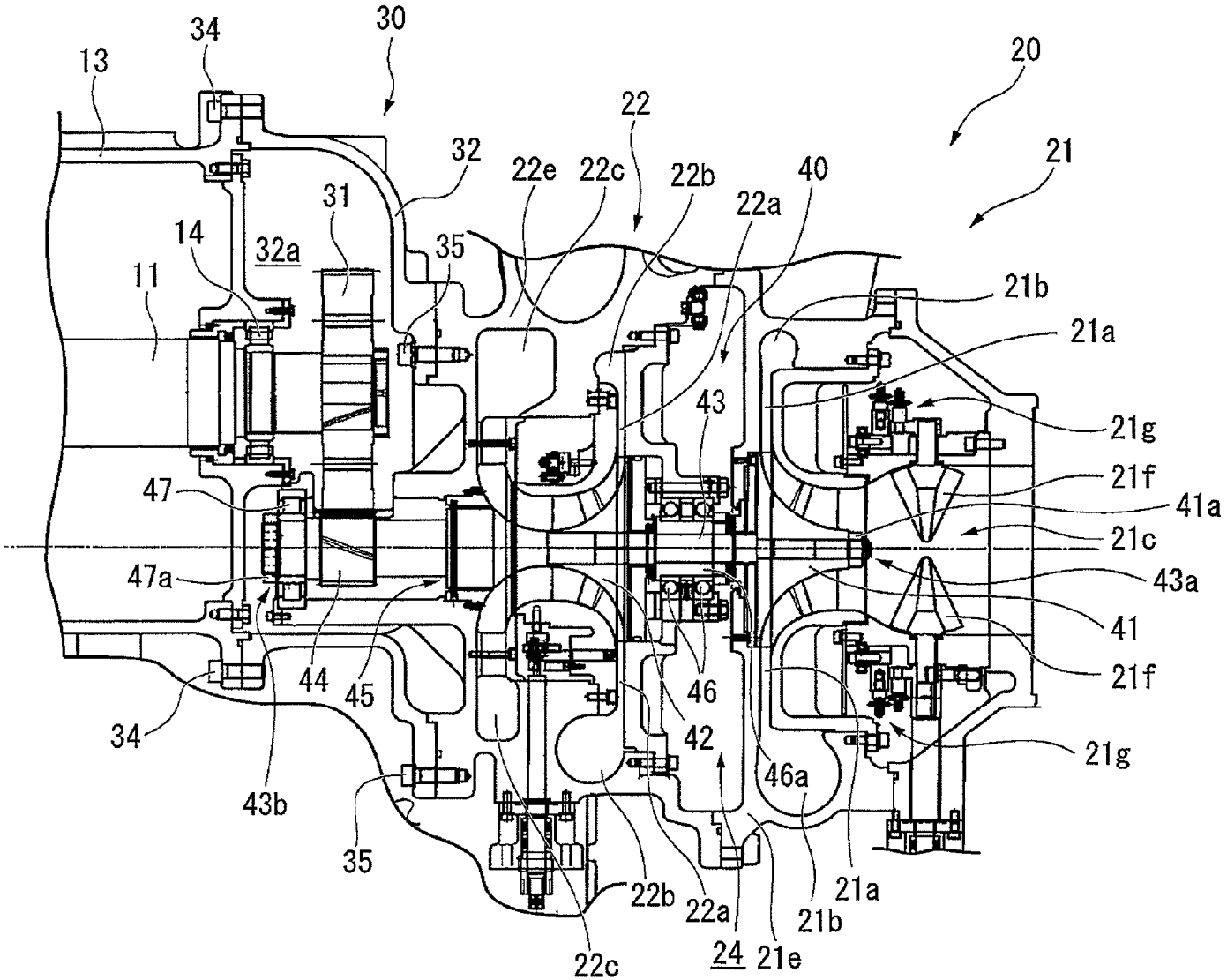
FIG. 3 is a horizontal enlarged cross-sectional view of a compressor unit and a gear unit according to the embodiment of the invention.

FIG. 3 is a horizontal enlarged cross-sectional view of the compressor unit 20 and the gear unit 30 according to this embodiment. As shown in FIG. 3, the compressor unit 20 includes the first compression stage 21 that intakes and compresses the refrigerant gas X4 (see FIG. 1) and the second compression stage 22 that further compresses the refrigerant gas X4 compressed by the first compression stage 21 to be discharged as the compressed refrigerant gas X1 (see FIG. 1). In addition, inside the compressor unit 20, a rotor assembly 40 that is provided over the first and second compression stages 21 and 22 so as to be rotatable is provided. In the rotor assembly 40, a first impeller 41 (impeller) and a second impeller 42 are fixed to a rotation shaft 43 extending in a predetermined direction (a direction in which the first and second compression stages 21 and 22 are opposed). A description of the rotor assembly 40 will be provided later.

The first compression stage 21 includes a first diffuser 21*a* that compresses the refrigerant gas X4 by converting the velocity energy of the refrigerant gas X4 applied by the rotating first impeller 41 into pressure energy, a first scroll chamber 21*b* that leads the refrigerant gas X4 compressed by the first diffuser 21*a* to the outside of the first compression stage 21, and an intake 21*c* that intakes the refrigerant gas X4 to be supplied to the first impeller 41. The first diffuser 21*a*, the first scroll chamber 21*b*, and the intake 21*c* are formed by a first impeller casing 21*e* that encloses the first impeller 41.

In the intake 21*c* of the first compression stage 21, a plurality of inlet guide vanes 21*f* controlling the intake capacity of the first compression stage 21 are installed. Each of the inlet guide vanes 21*f* is rotated by a drive mechanism 21*g* fixed to the first impeller casing 21*e* so as to change the apparent area of the refrigerant gas X4 from the upstream side of a flow direction. In addition, outside the first impeller casing 21*e*, a vane driving unit 23 (see FIG. 2) that rotates and drives each of the inlet guide vanes 21*f* connected to the drive mechanism 21*g* is installed.

The second compression stage 22 includes a second diffuser 22*a* that compresses the refrigerant gas X4 by converting the velocity energy of the refrigerant gas X4 applied by the rotating second impeller 42 into pressure energy so as to be discharged as the compressed refrigerant gas X1, a second scroll chamber 22*b* that leads the compressed refrigerant gas X1 discharged from the second diffuser 22*a* to the outside of the second compression stage 22, and an introduction scroll chamber 22*c* that guides the refrigerant gas X4 compressed by the first compression stage 21 to the second impeller 42. The second diffuser 22*a*, the second scroll chamber 22*b*, and the introduction scroll chamber 22*c* are formed by a second impeller casing 22*e* (casing) that encloses the second impeller 42.

The first scroll chamber 21*b* of the first compression stage 21 and the introduction scroll chamber 22*c* of the second compression stage 22 are connected via an external pipe (not shown) which is provided separately from the first and second compression stages 21 and 22 such that the refrigerant gas X4 compressed by the first compression stage 21 is supplied to the second compression stage 22 via the external pipe.

As described above, in the rotor assembly 40, the first and second impellers 41 and 42 are fixed to the rotation shaft 43 extending in the predetermined direction (the direction in which the first and second compression stages 21 and 22 are opposed).

The first and second impellers 41 and 42 each have a configuration in which a plurality of blades are lined up in the peripheral direction on a peripheral surface of a substantially conical hub, and are fixed to the rotation shaft 43 so that their rear surface sides (bottom surface sides of the conical hubs) are in a posture opposed to each other. The first impeller 41 is fixed to one end portion 43*a* of the rotation shaft 43 on the first compression stage 21 side using a nut 41*a* (fastening member). The second impeller 42 is fixed to substantially the center portion of the rotation shaft 43 by shrinkage-fitting, press-fitting, or the like.

The rotation shaft 43 is, for example, a bar-shaped member molded of chrome molybdenum steel having high rigidity. A pinion gear 44 is provided on the gear unit 30 side of the rotation shaft 43. The pinion gear 44 is a gear that transmits rotating power of the motor 12 (see FIG. 2) to the first and second impellers 41 and 42 and is molded integrally with the rotation shaft 43 when the rotation shaft 43 is molded. Between the pinion gear 44 of the rotation shaft 43 and the second impeller 42, a labyrinth seal 45 that prevents leakage of the refrigerant gas from the second compression stage 22 toward the gear unit 30 is provided. The labyrinth seal 45 surrounds the rotation shaft 43 and is fixed thereto by shrinkage-fitting, press-fitting, or the like.

The rotation shaft 43 is provided with a third bearing 46 and a fourth bearing 47. Both the third and fourth bearings 46 and 47 are rolling-element bearings and support the rotation shaft 43 so as to be rotatable.

The third bearing 46 is a bearing (so-called an angular bearing) capable of supporting loads in both the radial and thrust directions. The third bearing 46 is fixed to the rotation shaft 43 via a sleeve 46*a* between the first and second impellers 41 and 42. The fourth bearing 47 is fitted and fixed to the other end portion 43*b* of the rotation shaft 43 on the gear unit 30 side by shrinkage-fitting, press-fitting, or the like. In order to hold the fourth bearing 47 fitted to the rotation shaft 43, the rotation shaft 43 is provided with a bearing snap ring 47*a* in a nut shape. A female threaded portion is formed on an inner peripheral side of the bearing snap ring 47*a* and is screwed and mounted to a male threaded portion formed on the other end portion 43*b* of the rotation shaft 43.

The third bearing 46 is fixed to the second impeller casing 22*e* in a space 24 between the first and second compression stages 21 and 22, and the fourth bearing 47 is fixed to the second impeller casing 22*e* on the gear unit 30 side. That is, the rotation shaft 43 is supported inside the second impeller casing 22*e* so as to be rotatable via the third and fourth bearings 46 and 47.

The rotation shaft 43 according to this embodiment will be described in more detail.

Figure 4A:
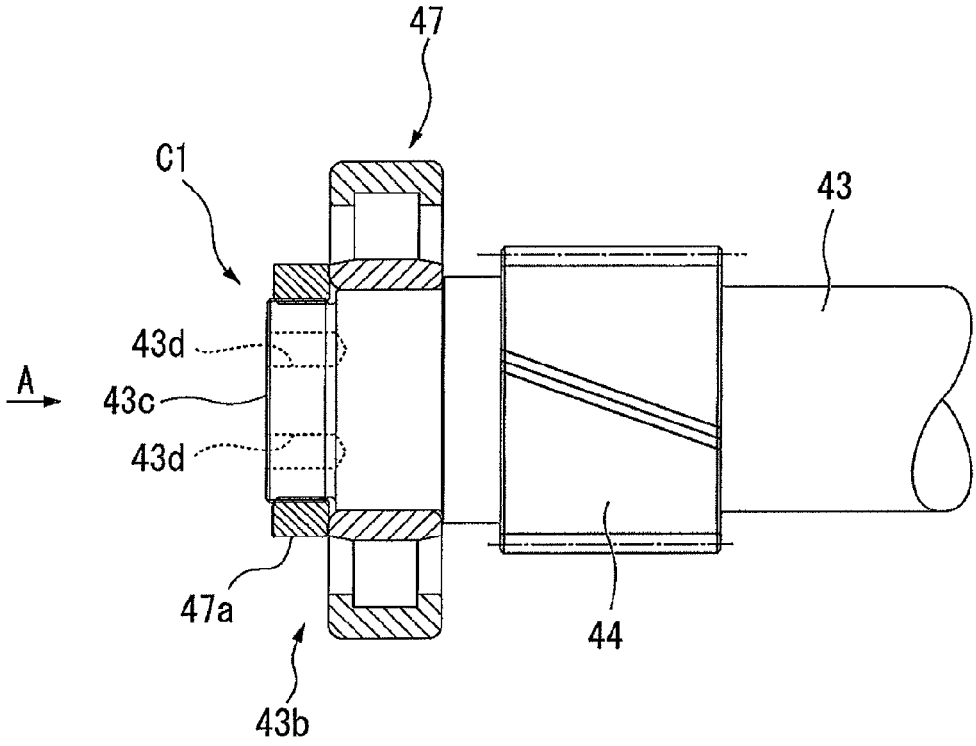
FIG. 4A is a schematic diagram of a rotation shaft according to the embodiment of the invention.
Figure 4B:
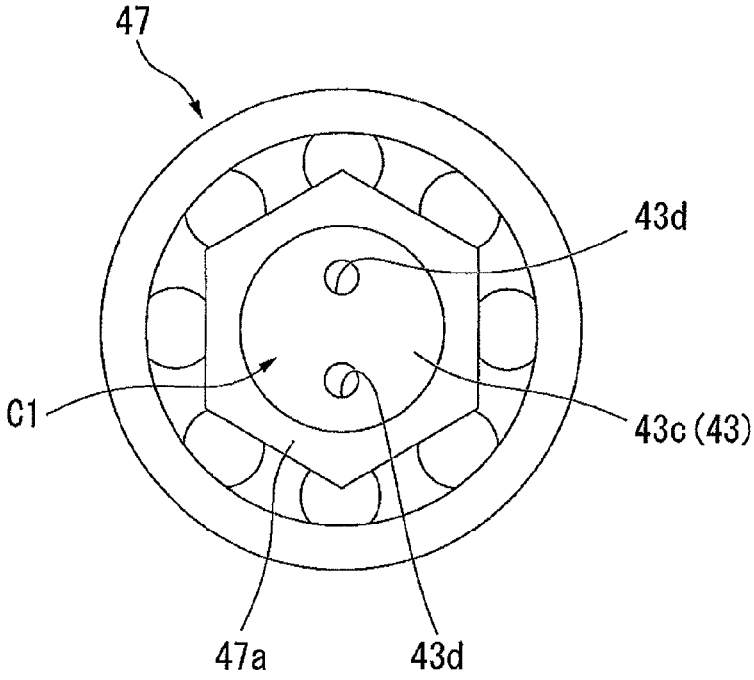
FIG. 4B is a schematic diagram of the rotation shaft according to the embodiment of the invention.

FIGS. 4A and 4B are schematic diagrams of the rotation shaft 43 according to this embodiment, and FIG. 4A is a horizontal cross-sectional view of the other end portion 43*b* side. FIG. 4B is a diagram viewed from the arrow A of FIG. 4A.

The other end portion 43*b* of the rotation shaft 43 is provided with a regulating portion C1 used for regulating the rotation of the rotation shaft 43 when the first impeller 41 is fixed to the rotation shaft 43. The regulating portion C1 cooperates with a rotation regulating member connected to the regulating portion C1, which will be described later, so as to regulate the rotation of the rotation shaft 43. The regulating portion C1 is formed as two female threaded portions 43*d* (recessed portions) provided in an end surface 43*c* of the other end portion 43*b* of the rotation shaft 43. The female threaded portions 43*d* are formed into recessed shapes recessed from the end surface 43*c* to extend in a direction parallel to the axial line of the rotation shaft 43.

Since the regulating portion C1 is formed as the two female threaded portions 43*d*, the regulating portion C1 is provided in the rotation shaft 43 without protruding from the end surface 43*c*. Accordingly, while the rotation shaft 43 has the regulating portion C1 used for regulating the rotation, the overall length of the rotation shaft 43 can be reduced. As the rotation shaft 43 is reduced in length, for example, the turbo compressor 4 becomes reduced in size and weight. In addition, since the female threaded portions 43*d* can be easily formed, the laboriousness and costs of processing can be reduced as compared with a case where a protruding portion having a shape of the head portion of a hexagon bolt is formed in the end surface 43*c*.

Returning to FIG. 3, the gear unit 30 includes a flat gear 31 which transmits the rotating power of the motor 12 to the rotation shaft 43 from the output shaft 11, and is fixed to the output shaft 11 of the motor 12 and engaged with the pinion gear 44 of the rotation shaft 43, and a gear casing 32 which accommodates the flat gear 31 and the pinion gear 44.

The flat gear 31 has an outside diameter greater than that of the pinion gear 44, and as the flat gear 31 and the pinion gear 44 cooperate with each other, the rotating power of the motor 12 is transmitted to the rotation shaft 43 so that the number of the rotation shaft 43 rotations becomes greater than that of the output shaft 11. A transmission method is not limited to the above method, and the diameters of a plurality of gears may be set so that the number of rotation shaft 43 rotations is the same as or smaller than that of the output shaft 11.

The gear casing 32 accommodates the flat gear 31 and the pinion gear 44 in an internal space 32*a* formed therein and are molded as a separate member from the motor casing 13 and the second impeller casing 22*e* so as to connect the motor casing 13 and the second impeller casing 22*e*. In addition, to the gear casing 32, an oil tank 33 (see FIG. 2) that recovers and stores a lubricating oil supplied to sliding parts of the turbo compressor 4 is connected. The gear casing 32 is connected to the motor casing 13 using a plurality of fastening bolts 34 and is connected to the second impeller casing 22*e* using a plurality of second fastening bolts 35.

Figure 5:
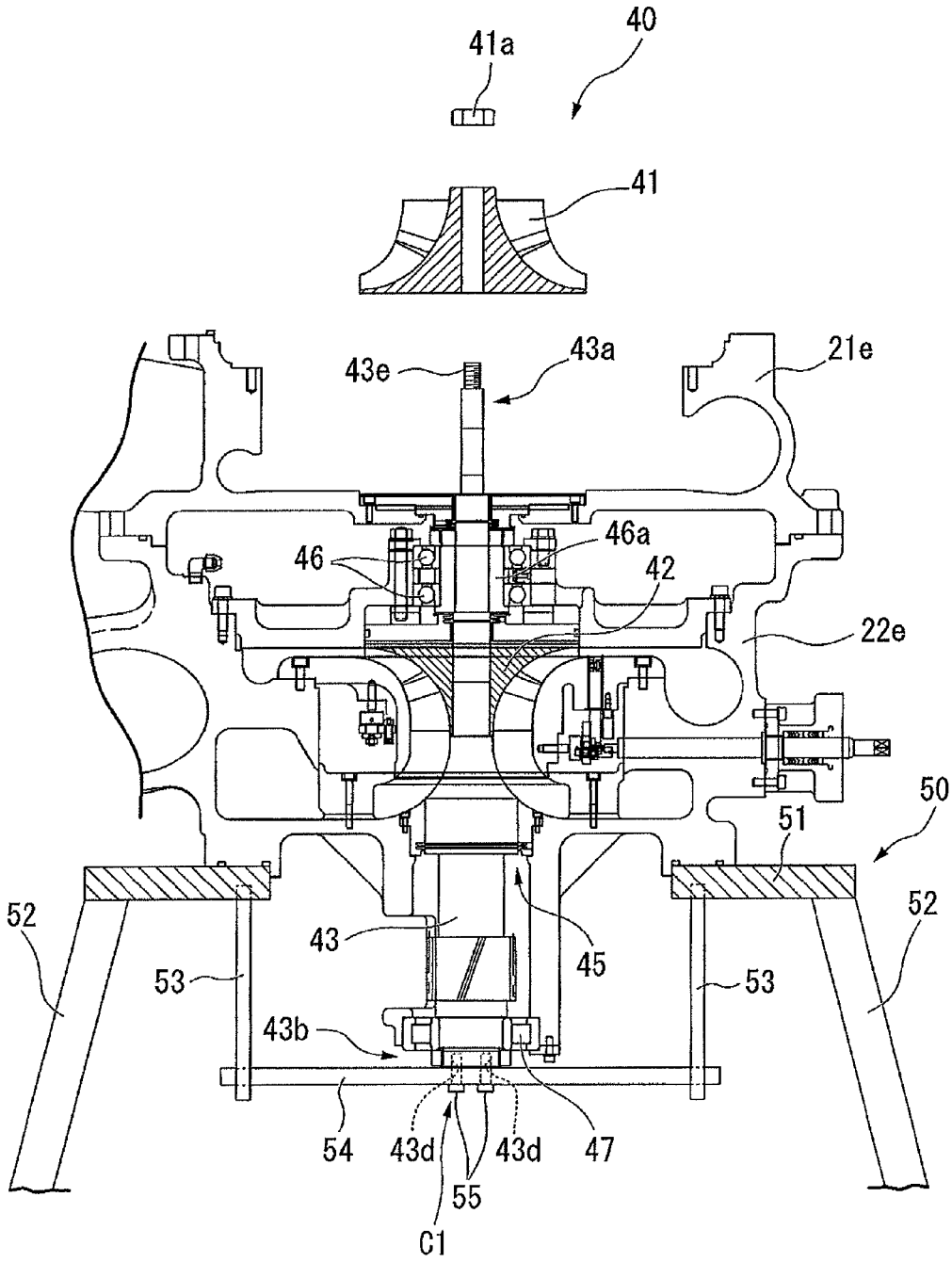
FIG. 5 is a schematic diagram showing a method of fixing a first impeller to the rotation shaft according to the embodiment of the invention.

Subsequently, a method of manufacturing the turbo compressor 4 will be described. A method of fixing the first impeller 41 to the rotation shaft 43 which is a feature of this embodiment will be mainly described, and a manufacturing method of other parts will be omitted. FIG. 5 is a schematic diagram showing the method of fixing the first impeller 41 to the rotation shaft 43 according to this embodiment. The up and down direction in FIG. 5 represent the vertical direction during manufacturing.

As shown in FIG. 5, in order to perform an operation of fixing the first impeller 41 to the rotation shaft 43, a holding stand 50 is used. The holding stand 50 is used during assembly and manufacturing the turbo compressor 4. The holding stand 50 includes a holding top plate 51, a plurality of leg portions 52, a plurality of regulating bars 53, and a rotation regulating member 54. The holding top plate 51 is molded in a flat plate shape having an opening portion at the center, and the second impeller casing 22*e* of the turbo compressor 4 is held on the upper surface of the holding top plate 51. The plurality of leg portions 52 is joined to the periphery of the holding top plate 51, and extends downward in the vertical direction to support the holding top plate 51. The plurality of regulating bars 53 is bar-shaped members provided on the lower surface side of the holding top plate 51 and extending downward in the vertical direction. The regulating bars 53 lock the rotation regulating member 54. One end portion of the regulating bar 53 is provided with a male threaded portion, and the male threaded portion is screwed and fixed to a female threaded portion (not shown) provided in the lower surface of the holding top plate 51. The rotation regulating member 54 is a bar-shaped member extending in a direction and is a member for regulating the rotation of the rotation shaft 43 by cooperating with the regulating portion C1 of the rotation shaft 43.

The method of fixing the first impeller 41 to the rotation shaft 43 includes a step of holding the second impeller casing 22*e* on the holding stand 50 (first manufacturing step), a step of installing the rotation shaft 43 of the rotor assembly 40 in the second impeller casing 22*e* to be rotatable (second manufacturing step), a step of fixing the first impeller casing 21*e* to the second impeller casing 22*e*, a step of connecting and fixing the rotation regulating member 54 to the regulating portion C1 of the rotation shaft 43 (third manufacturing step), and a step of fixing the first impeller 41 to the one end portion 43*a* of the rotation shaft 43 while the rotation regulating member 54 is locked by the regulating bar 53 (fourth manufacturing step). Hereinafter, each step will be described in detail.

First, the second impeller casing 22*e* is held on the holding top plate 51 of the holding stand 50 (the first manufacturing step). A part of the second impeller casing 22*e* held on the holding stand 50, at which the fourth bearing 47 is installed, penetrates through the opening portion of the holding top plate 51 and is positioned below the lower surface of the holding top plate 51 in the vertical direction. The second impeller casing 22*e* may be temporarily fixed to the holding top plate 51 or may be fixed using a female threaded portion (not shown) to which the second fastening bolt 35 of the second impeller casing 22*e* is screwed.

Next, the rotation shaft 43 of the rotor assembly 40 is installed in the second impeller casing 22*e* so as to be rotatable (the second manufacturing step). To the rotation shaft 43 installed in the second impeller casing 22*e*, the second impeller 42, the labyrinth seal 45, and the third and fourth bearings 46 and 47 are already fixed, and the regulating portion C1 is provided in the other end portion 43*b*.

Next, the first impeller casing 21*e* is fixed to the second impeller casing 22*e*. A plurality of fastening bolts (not shown) or the like is used for the fixing. In addition, at a connection position between the first and second impeller casings 21*e* and 22*e*, a predetermined seal member is provided in order to prevent leakage of the refrigerant gas X4 from the space 24 (see FIG. 3) to the outside.

Next, the rotation regulating member 54 is connected and fixed to the regulating portion C1 provided in the other end portion 43*b* of the rotation shaft 43 (the third manufacturing step). The rotation regulating member 54 is fixed to the regulating portion C1 by two third fastening bolts 55 (screw members). The third fastening bolts 55 are screwed and fixed to the plurality of female threaded portions 43*d* that configures the regulating portion C1. The rotation regulating member 54 fixed to the regulating portion C1 extends in the horizontal direction and is rotatable around the axial line of the rotation shaft 43 as the rotation shaft 43 rotates.

Last, the first impeller 41 is fixed to the one end portion 43*a* of the rotation shaft 43 by the nut 41*a* (the fourth manufacturing step). After mounting the first impeller 41 to the one end portion 43*a* of the rotation shaft 43, the nut 41*a* is screwed and fastened to the male threaded portion 43*e* provided in the one end portion 43*a*. Since the rotation shaft 43 is installed in the second impeller casing 22*e* so as to be rotatable, the rotation shaft 43 is rotated around the axial line during the fastening of the nut 41*a*. The rotation regulating member 54 is fixed to the regulating portion C1 of the rotation shaft 43, so that the rotation regulating member 54 is also rotated as the rotation shaft 43 is rotated. As the rotation regulating member 54 is rotated, the rotation regulating member 54 comes into contact with the regulating bar 53 and is locked, and thus the rotation of the rotation regulating member 54 is regulated. Accordingly, the rotation of the rotation shaft 43 fixed to the rotation regulating member 54 is also regulated. Therefore, the rotation of the rotation shaft 43 can be regulated during the fastening of the nut 41*a*.

In the state where the rotation of the rotation shaft 43 is regulated, the nut 41*a* is fastened to the male threaded portion 43*e* so as to fix the first impeller 41 to the one end portion 43*a* of the rotation shaft 43. A torque wrench or the like capable of applying a predetermined torque for fastening is used for fastening the nut 41*a*. Since the rotation of the rotation shaft 43 is stably regulated by the cooperation of the regulating portion C1 and the rotation regulating member 54, the first impeller 41 can be fixed to the rotation shaft 43 by the nut 41*a* without the use of a tool such as a wrench for regulating the rotation of the rotation shaft 43. As such, fixing of the first impeller 41 to the rotation shaft 43 is completed.

Subsequently, operations of the turbo compressor 4 according to this embodiment will be described.

First, the rotating power of the motor 12 is transmitted to the rotation shaft 43 via the flat gear 31 and the pinion gear 44, and thus the first and second impellers 41 and 42 of the compressor unit 20 are driven to rotate.

When the first impeller 41 is driven to rotate, the intake 21*c* of the first compression stage 21 is in a negative pressure stage, so that the refrigerant gas X4 flows into the first compression stage 21 via the intake 21*c* from the flow path R5. The refrigerant gas X4 flowing into the first compression stage 21 flows to the first impeller 41 in the thrust direction and is given velocity energy by the first impeller 41 so as to be discharged in the radial direction. The refrigerant gas X4 discharged from the first impeller 41 is compressed as its velocity energy is converted into pressure energy by the first diffuser 21*a*. The refrigerant gas X4 discharged from the first diffuser 21*a* is led to the outside of the first compression stage 21 via the first scroll chamber 21*b*. The refrigerant gas X4 led to the outside of the first compression stage 21 is supplied to the second compression stage 22 via the external pipe (not shown).

The refrigerant gas X4 supplied to the second compression stage 22 flows into the second impeller 42 in the thrust direction via the introduction scroll chamber 22*c* and is discharged in the radial direction in which velocity energy is applied thereto by the second impeller 42. The refrigerant gas X4 discharged from the second impeller 42 is further compressed as its velocity energy is converted into pressure energy by the second diffuser 22*a* to become the compressed refrigerant gas X1. The compressed refrigerant gas X1 discharged from the second diffuser 22*a* is led to the outside of the second compression stage 22 via the second scroll chamber 22*b*. The compressed refrigerant gas X1 led to the outside of the second compression stage 22 is supplied to the condenser 1 via the flow path R1. As such, the operations of the turbo compressor 4 are ended.

According to this embodiment, the following advantages can be obtained.

According to this embodiment, the regulating portion C1 used for regulating the rotation of the rotation shaft 43 is provided without protruding from the end surface 43*c* of the other end portion 43*b* of the rotation shaft 43. Accordingly, in the turbo compressor 4 and the turbo refrigerator S1, there is an advantage that the overall length of the rotation shaft 43 can be reduced. In addition, there is an advantage that the turbo compressor 4 having the rotation shaft 43 the overall length of which is reduced can be manufactured while including the regulating portion C1.

While the exemplary embodiments related to the invention have been described with reference to the accompanying drawings, it is needless to say that the invention is not limited to the embodiments. The shapes and combinations of the constituent members described in the above embodiments are only examples and can be modified in various manners depending on design requirements without departing from the spirit and scope of the invention.

For example, in this embodiment, the turbo compressor 4 is used in the turbo refrigerator S1. However, the invention is not limited thereto, and the turbo compressor 4 may also be used as a supercharger that supplies compressed air to an internal combustion engine.

Figure 6A:
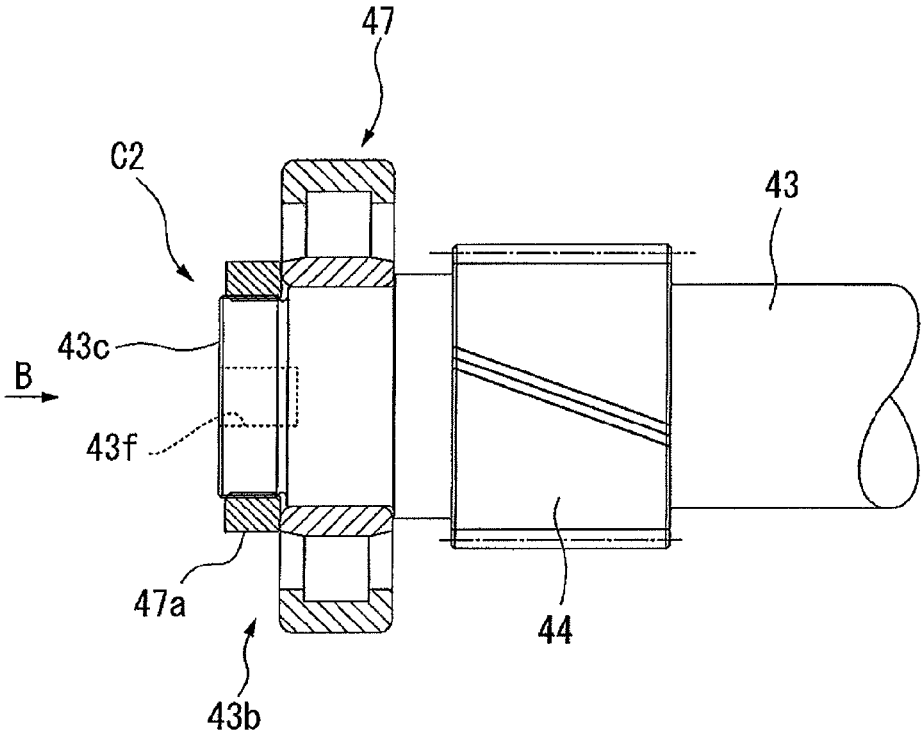
FIG. 6A is a schematic diagram showing a modified example of the rotation shaft according to the embodiment of the invention.
Figure 6B:
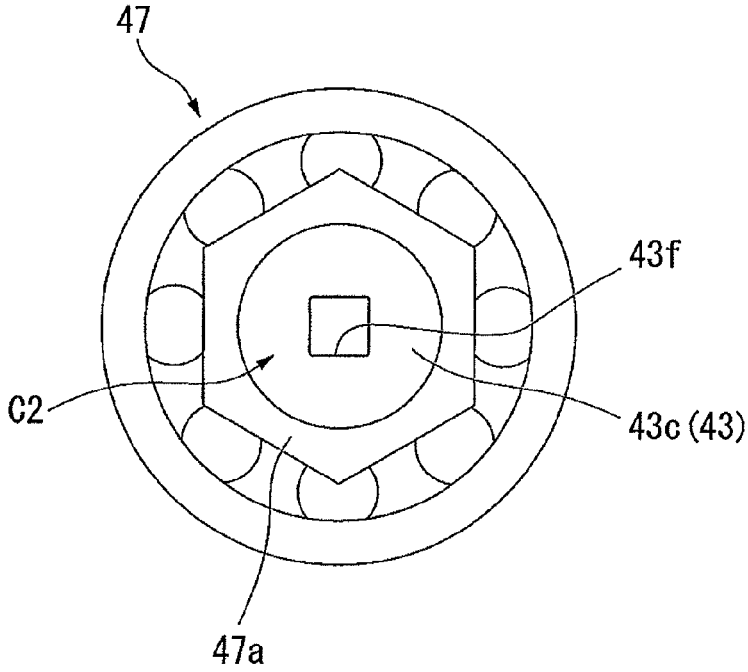
FIG. 6B is a schematic diagram showing the modified example of the rotation shaft according to the embodiment of the invention.

In addition, in this embodiment, instead of the regulating portion C1 provided in the rotation shaft 43, a regulating portion C2 illustrated in FIGS. 6A and 6B may also be used. FIGS. 6A and 6B are schematic diagrams showing a modified example of the rotation shaft 43 according to this embodiment, and FIG. 6A is a horizontal cross-sectional view of the other end portion 43*b* side. FIG. 6B is a diagram viewed from the arrow 13 of FIG. 6A. The regulating portion C2 is formed as a recessed portion 43*f* recessed from the end surface 43*c*. A cross-sectional shape of the recessed portion 43*f* on the surface perpendicular to the axial line is rectangular. The rotation regulating member 54 is connected and fixed to the regulating portion C2 provided as the recessed portion 43*f*, so that the rotation of the rotation shaft 43 can be regulated by the cooperation of the regulating portion C2 and the rotation regulating member 54. A protruding portion corresponding to the shape of the recessed portion 43*f* is provided in the rotation regulating member 54, and the protruding portion has a shape so as to be engaged with the recessed portion 43*f* at least around the axial line of the rotation shaft 43. The cross-sectional shape of the recessed portion 43*f* is not limited to the rectangular shape and may also have a polygonal shape or a slotted-hole shape. In addition, a plurality of the recessed portions 43*f* may also be provided.

In addition, in this embodiment, the rotation regulating member 54 is molded into a bar shape. However, the invention is not limited thereto, and the rotation regulating member 54 may have a shape so as to be at least partially engaged with the holding stand 50. Moreover, although the rotation regulating member 54 is locked by the regulating bar 53, a configuration in which the rotation regulating member 54 is locked by the plurality of leg portions 52 of the holding stand 50 without the regulating bar 53 may also be employed.

In addition, in this embodiment, fixing of the first impeller 41 to the rotation shaft 43 is performed in the state where the second impeller casing 22*e* is held on the holding stand 50. However, the invention is not limited thereto, and the rotation of the rotation shaft 43 may also be regulated using a predetermined rotation regulating tool that is connected to the regulating portions C1 and C2 and hold the regulating portions C1 and C2.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

an impeller fixed to one end portion of a rotation shaft by a predetermined fastening member; and a regulating portion which is used to regulate rotation of the rotation shaft during fastening of the fastening member and is provided in the other end portion of the rotation shaft, wherein the regulating portion is formed as a recessed portion recessed from an end surface of the other end portion of the rotation shaft, wherein a plurality of the recessed portions are provided.

2. The turbo compressor according to claim 1, wherein the recessed portion is a female threaded portion.

3. The turbo compressor according to claim 1, wherein a cross-sectional shape of the recessed portion on a surface perpendicular to an axial line of the rotation shaft is polygonal.

4. A turbo refrigerator comprising:

a condenser which cools a compressed refrigerant so as to be liquefied;

an evaporator which takes away heat of vaporization from a cooling object that vaporizes the liquefied refrigerant thereby cooling the cooling object; and a compressor which compresses the refrigerant vaporized by the evaporator and supplies the compressed refrigerant to the condenser, wherein the turbo compressor according to claim 1 is included as the compressor.

5. A turbo refrigerator comprising:

a condenser which cools a compressed refrigerant so as to be liquefied;

an evaporator which takes away heat of vaporization from a cooling object that vaporizes the liquefied refrigerant thereby cooling the cooling object; and a compressor which compresses the refrigerant vaporized by the evaporator and supplies the compressed refrigerant to the condenser, wherein the turbo compressor according to claim 3 is included as the compressor.

6. A turbo refrigerator comprising:

a condenser which cools a compressed refrigerant so as to be liquefied;

an evaporator which takes away heat of vaporization from a cooling object that vaporizes the liquefied refrigerant thereby cooling the cooling object; and a compressor which compresses the refrigerant vaporized by the evaporator and supplies the compressed refrigerant to the condenser, wherein the turbo compressor according to claim 5 is included as the compressor.

7. A method of manufacturing a turbo compressor which includes an impeller fixed to one end portion of a rotation shaft by a predetermined fastening member, and a regulating portion which is used to regulate rotation of the rotation shaft during fastening of the fastening member and is provided in the other end portion of the rotation shaft, the method comprising:

a first manufacturing step of holding a casing of the turbo compressor using a predetermined holding stand;

a second manufacturing step of installing the rotation shaft in the casing so as to be rotatable;

a third manufacturing step of connecting a rotation regulating member that regulates the rotation of the rotation shaft by cooperating with the regulating portion, to the regulating portion formed as a recessed portion recessed from an end surface of the other end portion of the rotation shaft; and a fourth manufacturing step of fixing the impeller to the one end portion of the rotation shaft using the fastening member in a state where the rotation regulating member is locked by a part of the holding stand.

8. The method according to claim 7, wherein the recessed portion is a female threaded portion, and in the third manufacturing step, the rotation regulating member is fixed to the regulating portion by a threaded member screwed to the female threaded portion.

* * * * *